US007748055B2

(12) United States Patent
Boehler

(10) Patent No.: US 7,748,055 B2
(45) Date of Patent: Jul. 6, 2010

(54) WRAP AND COVER-UP DEVICE

(76) Inventor: Jill Boehler, 7 Glen Lyon Ct., Phoenix, MD (US) 21131

( * ) Notice: Subject to any disclaimer, the term of this patent is extended or adjusted under 35 U.S.C. 154(b) by 12 days.

(21) Appl. No.: 11/535,256

(22) Filed: Sep. 26, 2006

(65) Prior Publication Data

US 2008/0092267 A1 Apr. 24, 2008

(51) Int. Cl.
*A41D 3/08* (2006.01)

(52) U.S. Cl. ..... 2/88; 2/207

(58) Field of Classification Search ..... 2/47, 2/48, 88, 67, 207, 211, 919, 279
See application file for complete search history.

(56) References Cited

U.S. PATENT DOCUMENTS

| | | | | | |
|---|---|---|---|---|---|
| 604,964 | A * | 5/1898 | Cain | 2/211 |
| 2,420,344 | A * | 5/1947 | Alexander | 2/69 |
| 2,698,944 | A * | 1/1955 | Ramsby | 2/174 |
| 3,167,077 | A * | 1/1965 | Bosko et al. | 401/8 |
| 3,587,114 | A * | 6/1971 | McCourtie | 2/67 |
| 3,704,469 | A * | 12/1972 | Levy | 2/67 |
| 4,301,547 | A | 11/1981 | Bloise | |
| 4,603,441 | A * | 8/1986 | Richter | 2/211 |
| 4,870,707 | A * | 10/1989 | Hayes | 2/207 |
| 5,083,318 | A * | 1/1992 | Hook | 2/207 |
| 5,440,762 | A | 8/1995 | Schill | |
| 5,454,643 | A * | 10/1995 | Sullivan | 383/4 |
| 5,533,653 | A * | 7/1996 | Kaufman | 224/577 |
| 6,175,964 | B1 * | 1/2001 | Adler | 2/207 |
| 6,179,025 | B1 * | 1/2001 | Sutton | 150/105 |
| 6,240,562 | B1 | 6/2001 | Martin | |
| 6,353,933 | B1 | 3/2002 | Love | |
| 6,360,370 | B1 | 3/2002 | Ferreras | |
| 6,584,617 | B1 | 7/2003 | Turner | |
| 2006/0010567 | A1 * | 1/2006 | Vazquez et al. | 2/175.1 |

OTHER PUBLICATIONS

Advertisement for "Nursing Shawl" by LovedBaby. Retrieved Jan. 17, 2007, from http://www.tinytots.com/shopping/for_mom/nursing_shawl.html.

* cited by examiner

*Primary Examiner*—Katherine Moran
*Assistant Examiner*—Richale L Quinn
(74) *Attorney, Agent, or Firm*—Heslin Rothenberg Farley & Mesiti P.C.

(57) ABSTRACT

A wrap and cover-up device can be conveniently stored and transported in a handbag while not in use and quickly accessed for use over a person's clothing or exposed skin to provide warmth and/or coverage when the need arises, all while remaining undamaged and substantially wrinkle free. The wrap and cover-up device includes an elongated piece of fabric capable of being compacted for storage and extended for use while remaining substantially wrinkle free, sized and configured when extended to fit laterally around at least a portion of a torso of a person. Also included is a container for receiving and maintaining the piece of fabric in the compacted state, whereby the piece of fabric in the compacted state fits within the container and the container with the compacted piece of fabric therein fits into the handbag.

18 Claims, 2 Drawing Sheets

WRAP AND COVER-UP DEVICE

FIELD OF THE INVENTION

The present invention relates to an article of clothing and more specifically, to a wrap that can be worn over clothing or exposed skin to provide warmth and/or coverage, which can be conveniently stored in a handbag when not in use and removed from the handbag for use, all while remaining undamaged and substantially wrinkle free.

BACKGROUND OF THE INVENTION

Wraps have been used for many years to serve both aesthetic and functional purposes. Traditionally though, wraps are used to provide warmth and/or skin coverage to the wearer. Wraps are particularly useful when a person does not want to carry or wear a bulky jacket or sweater. For example, when a person is only slightly chilled, a jacket or sweater would provide too much warmth. There are also times when a wrap is preferred to a jacket or sweater simply because a wrap is more fashionable. Typically, the wrap is draped around a person's shoulders to provide style, warmth and/or skin coverage. A wrap can also be tied around a person's waist to provide style, warmth and/or skin coverage, for example, when a woman is wearing a bathing suit.

When not in use, the wrap must be hung on a clothes hanger to prevent the wrap from becoming wrinkled. However, storage of the wrap becomes more problematic and burdensome when the wearer leaves his or her residence while wearing or carrying the wrap. While the wearer is away from his or her residence, often he or she does not have access to a clothes hanger. Under these circumstances, if the wearer becomes too warm, gets tired of carrying the wrap, or desires to remove the wrap for any reason, even if the removal is only temporary, the wearer must find a place to temporarily store the wrap. Ideally, in this situation, the wrap must be draped over a chair or laid out neatly on a table or other substantially flat surface to prevent wrinkling.

However, more often than not, the wearer will not have the time, opportunity and/or desire to ensure that the wrap is properly draped over a chair or laid out on a flat surface to prevent wrinkling. In such situations, the wrap is often stuffed into a handbag, left in an automobile, tossed in an automobile trunk, etc. If the wrap is left in an automobile, the person may not be able to access their wrap quickly if the need arises. If and when the wrap is retrieved from the automobile, handbag, etc., the wrap is wrinkled and unsightly, often preventing the person from wearing it again. In addition to becoming wrinkled, if the wrap is stuffed into a handbag, the wrap could be damaged by other items in the handbag, such as makeup. Moreover, even when the wrap is draped over a chair or laid out on a flat surface to prevent wrinkling, there are many problems: the wrap can easily slide off the chair onto the floor, where it can become dirty or trampled; the wrap can be easily forgotten or stolen; or the wrap can be exposed to rain, wind, beverages, etc. and become damaged or lost.

Many situations arise where a wrap would be useful, for example: when a person finds himself or herself inappropriately dressed for cooler weather; when the temperature changes, suddenly becoming cooler; when a person enters an air-conditioned venue; or when a person desires to cover exposed skin. However, because the transport and storage of wraps is tedious and problematic, many people simply choose not to wear a wrap or carry a wrap with them for later use. Therefore, it is often the case, that when the need or desire arises, people do not have access to a wrap.

Accordingly, there is a need for a wrap that can be conveniently stored and transported while not in use and quickly accessed for use when the need arises, all while the wrap remains undamaged and substantially wrinkle free.

BRIEF SUMMARY OF THE INVENTION

The present invention provides a wrap and cover-up device that can be conveniently stored and transported in a handbag while not in use and quickly accessed for use when the need arises, all while remaining undamaged and substantially wrinkle free.

An aspect of the present invention relates to a wrap comprising a piece of fabric capable of being compacted for storage and extended for use while remaining substantially wrinkle free; the piece of fabric being sized and configured when extended to fit laterally around at least a portion of a torso of a person; the piece of fabric having a top edge and a bottom edge extending in a lengthwise direction wherein a maximum length of the piece is greater than a maximum width of the piece and wherein a ratio of the maximum length to the maximum width is equal to or greater than two; and the piece of fabric being compactable so that the piece of fabric when in a compacted state can fit into a three dimensional space having dimensions no greater than 13 cm by 12 cm by 6 cm, whereby the piece of fabric in the compacted state can be stored in a handbag.

A second aspect of the invention relates to a cover-up device comprising a piece of fabric as described above; and a container for receiving and maintaining the piece of fabric in the compacted state, whereby the piece in the compacted state fits within the container and the container with the compacted piece therein fits into the handbag.

A third aspect of the invention relates to a method of providing the cover-up device as described above. The method comprises: cutting the piece of fabric to the size and configuration that fits laterally around at least the portion of the torso of the person when extended; and placing the piece when in the compacted state in a container that can fit in the handbag.

A fourth aspect of the invention relates to a method of using the cover-up device as described above. The method comprises: removing the compacted piece of fabric from the handbag; extending the piece; placing the extended piece laterally around at least the portion of the torso of the person; subsequently removing the piece from the portion of the torso; compacting the piece; and storing the compacted piece in the handbag.

BRIEF DESCRIPTION OF THE DRAWINGS

These and other features, aspects and advantages of the present invention will become apparent from the following description of preferred embodiments, when read in conjunction with the accompanying drawings, in which.

DETAILED DESCRIPTION OF THE INVENTION

Throughout the specification the terms and substituents are defined when first introduced and retain their definitions.

The present invention relates to a wrap comprising a piece of fabric capable of being compacted for storage and extended for use while remaining substantially wrinkle free. The piece of fabric is sized and configured, so that when extended, it will fit laterally around at least a portion of the torso of a person. The torso of a person is the entire human body excluding the head and limbs.

The piece of fabric may be composed of a polyester-blend, which retains body warmth and can be compacted for storage and extended for use while remaining substantially wrinkle free.

Figure 1:
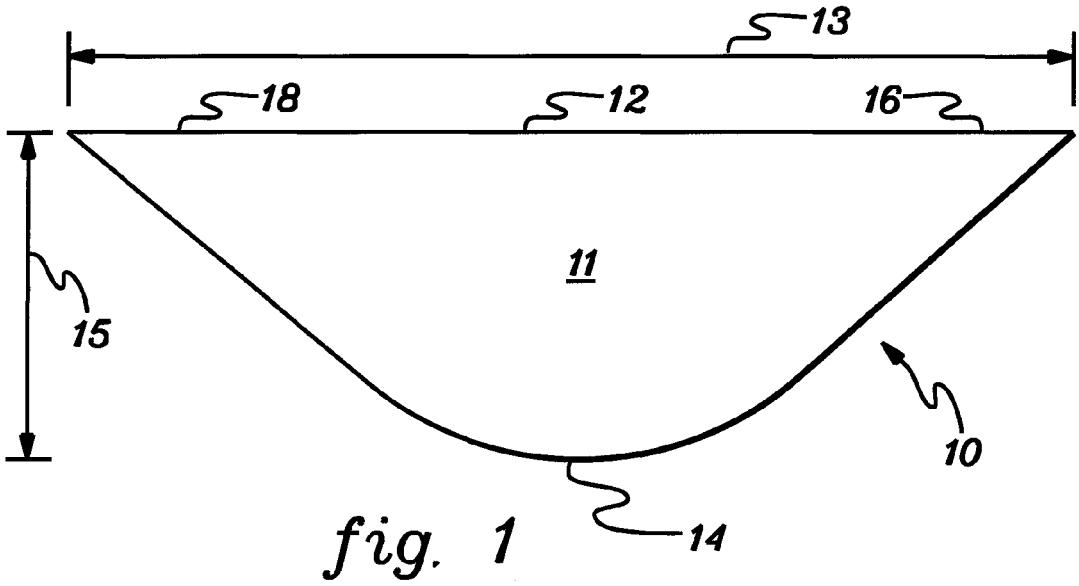
FIG. 1 depicts a plan view of a wrap in accordance with the present invention.

Turning to FIG. 1, there is shown a wrap 10 comprising a piece of fabric 11 in an extended state according to the present invention. The piece of fabric is in the extended state when it is fully expanded in all directions. The piece of fabric 11 in the extended state has a top edge 12 and a bottom edge 14, both extending generally in a lengthwise direction. A maximum length 13 of the piece of fabric is greater than a maximum width 15 of the piece of fabric and a ratio of the maximum length to the maximum width is equal to or greater than two, and preferably equal to or greater than three. The top edge 12 may be substantially straight and at least a portion of the bottom edge 14 may be curved. The piece of fabric may be configured in various shapes, such as a crescent, an obround, a semicircle, a triangle, a rectangle or a segment of a circle. The piece of fabric 11 has a left end 18 and a right end 16 adapted to secure the wrap around a portion of the torso 25. The left end 18 and the right end 16 may be secured by tying or by fastening the left end 18 and the right end 16 together with, for example, a pin, clip, button or other fastener.

As shown, the piece of fabric is continuous and holeless. Unlike poncho-type garments, the wrap need not contain an opening in the center to receive a person's head thus simplifying the fabrication. Unlike some shawl-type garments, the wrap is not perforated, thereby retaining body warmth. The wrap may be provided in different colors, sizes, shapes, patterns, designs, fabrics, finishes and decorations.

Figure 1A:
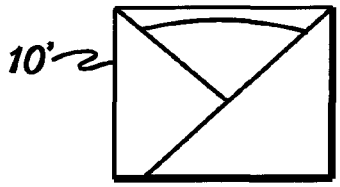
FIG. 1A depicts the wrap of FIG. 1 in a compacted state.

In FIG. 1A, there is shown the wrap 10' in a compacted state. While in the compacted state, the piece of fabric fits into a three dimensional space having dimensions no greater than 13 cm by 12 cm by 6 cm, so that the compacted piece of fabric can be readily stored in a handbag. The wrap may be compacted by folding, compressing, rolling, crumbling or otherwise compacting; folding being presently preferred.

The present invention further relates to a cover-up device comprising a wrap as described above and a container for receiving and maintaining the wrap in the compacted state. The wrap in the compacted state fits within the container and the container with the compacted wrap therein fits into a handbag. A handbag is any bag, pouch, case or container carried by a person and typically used to store and/or transport items such as keys, a wallet, money, make-up and other personal items. Examples of handbags include: purses, clutches, pocketbooks, wristlets, duffles, totes, satchels and small pieces of luggage.

Figure 2A:
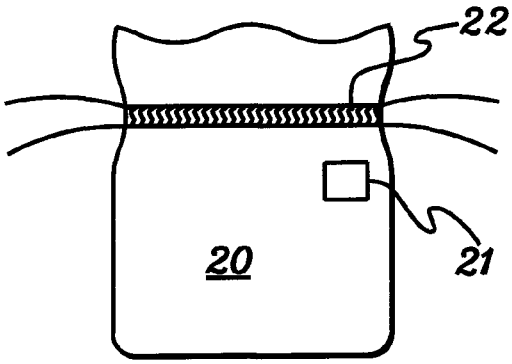
FIG. 2A depicts a container for receiving and storing the wrap in the compacted state.

In FIG. 2A, there is shown an open container for storage and maintenance of the wrap 10' in the compacted state. The container is preferably a pouch 20 with a drawstring closure 22. The container is preferably malleable, both when empty and when filled with the compacted wrap. The container may take other forms and be made of various materials that retain and/or restrain the wrap 10' in the compacted state.

Figure 2B:
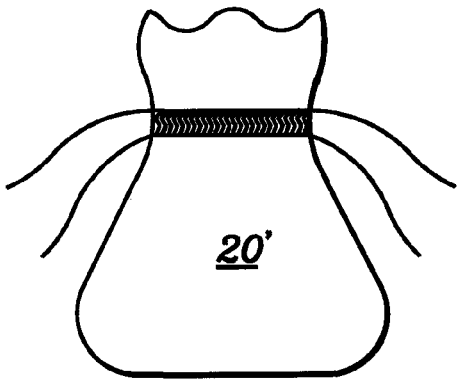
FIG. 2B depicts the container with the wrap stored and maintained in the compacted state therein.

In FIG. 2B, there is shown a closed container 20' with the compacted wrap therein. The container may communicate a feature of the compacted wrap contained therein. In one embodiment, a portion 21 of the container communicates a feature of the compacted wrap therein. The feature may be the color, style, size or other characteristic of the wrap compacted therein.

Figure 3:
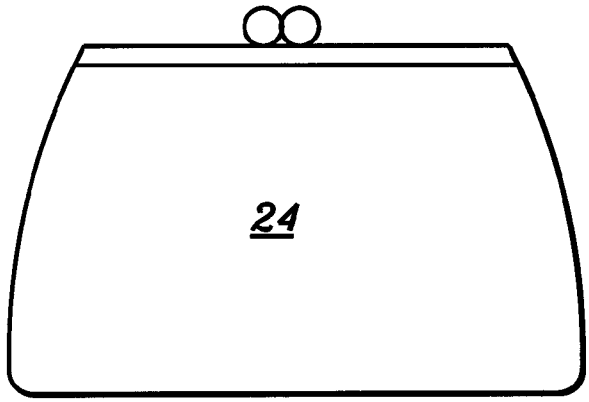
FIG. 3 depicts a handbag for receiving and carrying the container holding the compacted wrap.

In FIG. 3, there is shown a handbag 24. The closed container 20' with the compacted wrap therein can be placed in the handbag 24 for convenient storage and transport.

Figure 4:
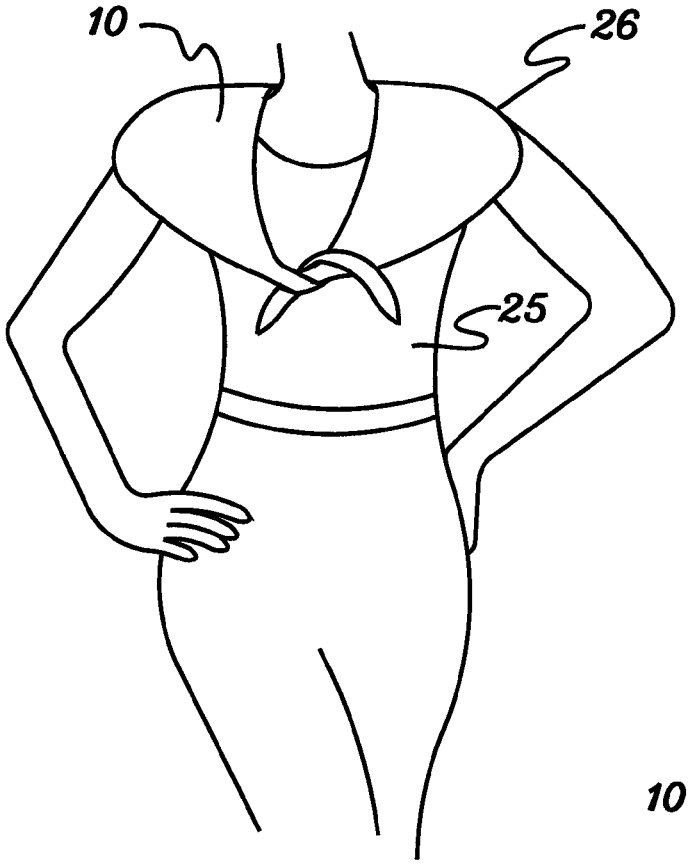
FIG. 4 depicts the wrap of the present invention as worn around the shoulders of a person.

In FIG. 4, there is shown the wrap 10 in the extended state placed around the torso 25 of a person. The wrap may be worn around a portion of the torso 25 to retain the body heat of a person. In the illustrated embodiment, the piece of fabric in the extended state is sized and configured to fit around the shoulders 26 and back of a person.

Figure 5:
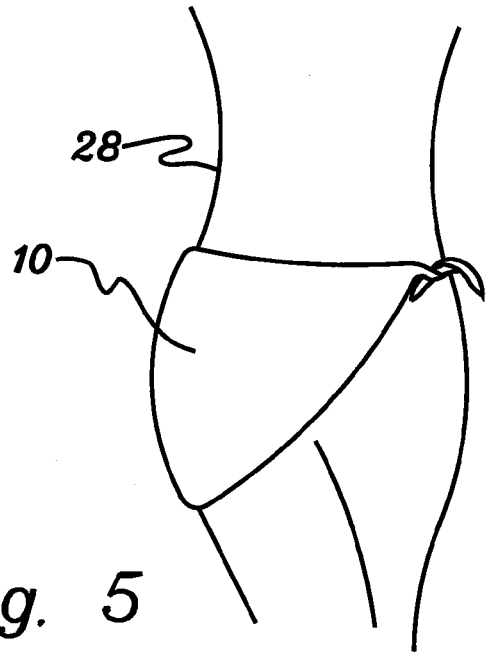
FIG. 5 depicts the wrap of the present invention as worn around the waist of a person.

In FIG. 5, there is shown the wrap 10 in the extended state placed around a different portion of the torso 25 of a person. In this embodiment, the piece of fabric in the extended state is sized and configured to fit around the waist 28 of a person.

The present invention also relates to a method of providing the wrap, wherein a piece of fabric is cut to a size and elongated configuration that fits laterally around at least a portion of the torso of the person when extended and is subsequently compacted and placed in a container that can fit in a handbag. The edges of the piece of fabric may optionally be finished in any known fashion.

In use, the container 20' with the compacted wrap therein is removed from the handbag 24, the compacted piece of fabric is removed from the container and extended. The piece of fabric 11 in the extended state may then be placed laterally around at least a portion of the torso of the person. Subsequently, the piece of fabric may be removed from the torso and compacted. The piece of fabric 10' in the compacted state may then be placed the container 20 that can fit in a handbag. The container with the compacted wrap therein may then be closed and placed in the handbag for convenient storage and transport.

The present invention provides a wrap that may be conveniently stored and transported in a handbag when not is use. When the wrap is retrieved from the handbag for use, the wrap remains substantially wrinkle free. The invention also provides for a container for the safe storage and maintenance of the wrap while inside the handbag. The wrap is capable of being compacted so that it will fit in the container. The container with the compacted wrap therein may then be closed and placed in the handbag, where the wrap is safely stored for future use, as the container will prevent the wrap from becoming damaged by other items in the handbag. Because the container with the compacted wrap therein fits in a handbag, the wrap may be permanently or temporarily stored in the handbag, providing a person quick and easy access to an undamaged, substantially wrinkle free wrap when ever the need or desire arises.

Although preferred embodiments have been described and depicted herein, it will be readily apparent to those skilled in this art, that various modifications, substitutions and changes can be made without departing from the scope of this invention, as defined by the appended claims.

What is claimed is:

1. A combination of a wrap and a container comprising: a non-perforated, continuous and holeless piece of fabric adapted to be compacted for storage and extended for use while remaining substantially wrinkle free; the piece of fabric being comprised of a polyester-blend; the piece of fabric being sized and configured when extended to fit laterally around at least a portion of a torso of a person; the piece of fabric when fully extended having a top edge and a bottom edge generally extending in a lengthwise direction wherein a maximum length of the piece is greater than a maximum width of the piece and wherein a ratio of the maximum length to the maximum width is equal to or greater than two; the piece of fabric being adapted to retain body heat of the person; the piece of fabric being compactable so that the piece of fabric when in a compacted state fits into a three dimensional space having dimensions no greater than 13 cm by 12 cm by 6 cm, whereby the piece of fabric in the compacted state can be stored in a handbag; and a separate, non-integral container for receiving and maintaining the piece of fabric in the compacted state, whereby the piece of fabric in the compacted state fits within the container and the container with the compacted piece therein fits into the handbag.

2. The combination of claim 1, wherein the top edge is substantially straight and at least a portion of the bottom edge is curved.

3. The combination of claim 1, wherein the piece of fabric additionally comprises a left end and a right end adapted to secure the piece around the portion of the torso.

4. The combination of claim 3, wherein the left end and the right end are secured by tying or fastening the left end and the right end together.

5. The combination of claim 1, wherein the piece of fabric is sized and configured to fit around shoulders and back of the person.

6. The combination of claim 1, wherein the piece of fabric is sized and configured to fit around waist of the person.

7. The combination of claim 1, wherein the container when empty is malleable.

8. The combination of claim 7, wherein the container with the compacted fabric therein remains malleable.

9. The combination of claim 1, wherein the container comprises a pouch having a drawstring closure.

10. The combination of claim 1, wherein the container communicates a feature of the piece of fabric.

11. The combination of claim 10, wherein the container communicates a color, size and/or style of the piece of fabric compacted therein.

12. The combination of claim 1, wherein the wrap is without elastic binding.

13. The combination of claim 1, wherein the maximum length of the piece is 64 inches and the maximum width of the piece is 19 inches.

14. The combination of claim 1, wherein the separate, non-integral container maintains and restrains a compacted wrap with dimensions no greater than 13 cm by 12 cm by 6 cm in the compacted state.

15. The combination of claim 1, wherein the piece of fabric is a heat retaining piece of fabric.

16. The combination of claim 1, wherein the ratio of the maximum length to the maximum width is equal to or greater than three.

17. A method of providing a wrap, comprising: selecting a piece of fabric adapted to retain body heat of a person and to be compacted for storage and extended for use while remaining substantially wrinkle free wherein the piece of fabric is comprised of a polyester-blend; cutting the piece of fabric to a size and configuration that fits laterally around at least a portion of a torso of an adult person when extended; compacting the piece of fabric into dimensions no greater than 13 cm by 12 cm by 6 cm; storing the piece of fabric in the compacted state in a handbag; and removing the piece of fabric from the handbag whereby the piece of fabric can be fully extended for use while remaining substantially wrinkle free.

18. A method of providing a wrap, comprising: selecting a piece of fabric adapted to retain body heat of a person and to be compacted for storage and extended for use while remaining substantially wrinkle free wherein the piece of fabric is comprised of a polyester-blend; cutting the piece of fabric to a size and configuration that fits laterally around at least a portion of a torso of an adult person when extended; compacting the piece of fabric into dimensions no greater than 13 cm by 12 cm by 6 cm; and placing the piece of fabric when in the compacted state into a separate, non-integral container that maintains the piece of fabric in the compacted state whereby the container with the compacted wrap therein has dimensions no greater than 13 cm by 12 cm by 6 cm.

* * * * *